US011547197B2

(12) United States Patent
Jeong et al.

(10) Patent No.: US 11,547,197 B2
(45) Date of Patent: Jan. 10, 2023

(54) COSMETIC CONTAINER

(71) Applicant: AMOREPACIFIC CORPORATION, Seoul (KR)

(72) Inventors: Hae Won Jeong, Yongin-si (KR); Seo Hui Jeong, Incheon (KR); Kyungho Choi, Yongin-si (KR)

(73) Assignee: AMOREPACIFIC CORPORATION, Seoul (KR)

( * ) Notice: Subject to any disclaimer, the term of this patent is extended or adjusted under 35 U.S.C. 154(b) by 424 days.

(21) Appl. No.: 16/713,706

(22) Filed: Dec. 13, 2019

(65) Prior Publication Data

US 2020/0187626 A1 Jun. 18, 2020

(30) Foreign Application Priority Data

Dec. 14, 2018 (KR) ..... 10-2018-0161949

(51) Int. Cl.
*A45D 40/00* (2006.01)
*B05B 15/25* (2018.01)

(52) U.S. Cl.
CPC ..... *A45D 40/00* (2013.01); *A45D 2200/053* (2013.01); *A45D 2200/056* (2013.01)

(58) Field of Classification Search
CPC ..... A45D 40/00; A45D 2200/053; A45D 2200/056; A45D 2200/058; A45D 34/04; A45D 40/0075; A45D 40/14; A45D 40/0068; A45D 34/00; A45D 34/06; A45D 40/18; A45D 44/005; A45D 2034/002; A45D 2044/007; B05D 11/007; B05D 15/25; B05D 11/0072; B05D 11/3023; B05D 11/3069; B05D 11/3074; B05D 11/3001; B05D 11/3073; B65D 81/32; B65D 2231/005
USPC ..... 141/113
See application file for complete search history.

(56) References Cited

U.S. PATENT DOCUMENTS

2002/0197228 A1* 12/2002 LaSala ..... B05B 11/3001 424/70.12
2008/0169312 A1* 7/2008 Kee ..... B05B 11/00416 222/405
2012/0267391 A1* 10/2012 Yoo ..... B05B 11/00416 222/23

(Continued)

FOREIGN PATENT DOCUMENTS

KR 101219009 1/2013
KR 200464645 Y1 * 1/2013

(Continued)

OTHER PUBLICATIONS

KR200338755Y1 English Translation of Specification (Year: 2022).*

(Continued)

*Primary Examiner* — Timothy P. Kelly
*Assistant Examiner* — Stephanie A Shrieves
(74) *Attorney, Agent, or Firm* — Cantor Colburn LLP

(57) ABSTRACT

The invention relates to a cosmetic container. According to one aspect of the invention, there is provided a cosmetic container, including: a storing unit providing a first storing space which can store fluid; a discharging unit which discharges the fluid stored in the storing unit to the outside; and a fluid supporting unit which can support from a lower direction fluid which has been discharged to the outside.

16 Claims, 8 Drawing Sheets

(56) References Cited

U.S. PATENT DOCUMENTS

| | | | | |
|---|---|---|---|---|
| 2015/0144662 | A1* | 5/2015 | Lim | A45D 40/24<br>222/190 |
| 2016/0088921 | A1* | 3/2016 | Jo | A45D 40/0075<br>222/173 |
| 2016/0235183 | A1* | 8/2016 | Lee | B01F 35/717 |
| 2020/0189827 | A1* | 6/2020 | Jeong | B01F 27/808 |

FOREIGN PATENT DOCUMENTS

| | | | | |
|---|---|---|---|---|
| KR | 200464645 | Y1 | 1/2013 | |
| KR | 200468348 | Y1 * | 8/2013 | |
| KR | 200338755 | | 10/2014 | |
| KR | 101548477 | | 8/2015 | |
| WO | WO-2011071301 | A2 * | 6/2011 | A45D 34/04 |

OTHER PUBLICATIONS

KR200464645Y1 English Translation of Specification (Year: 2022).*
WO-2011071301-A2 English Translation of Specification (Year: 2022).*

* cited by examiner

【FIG. 1】
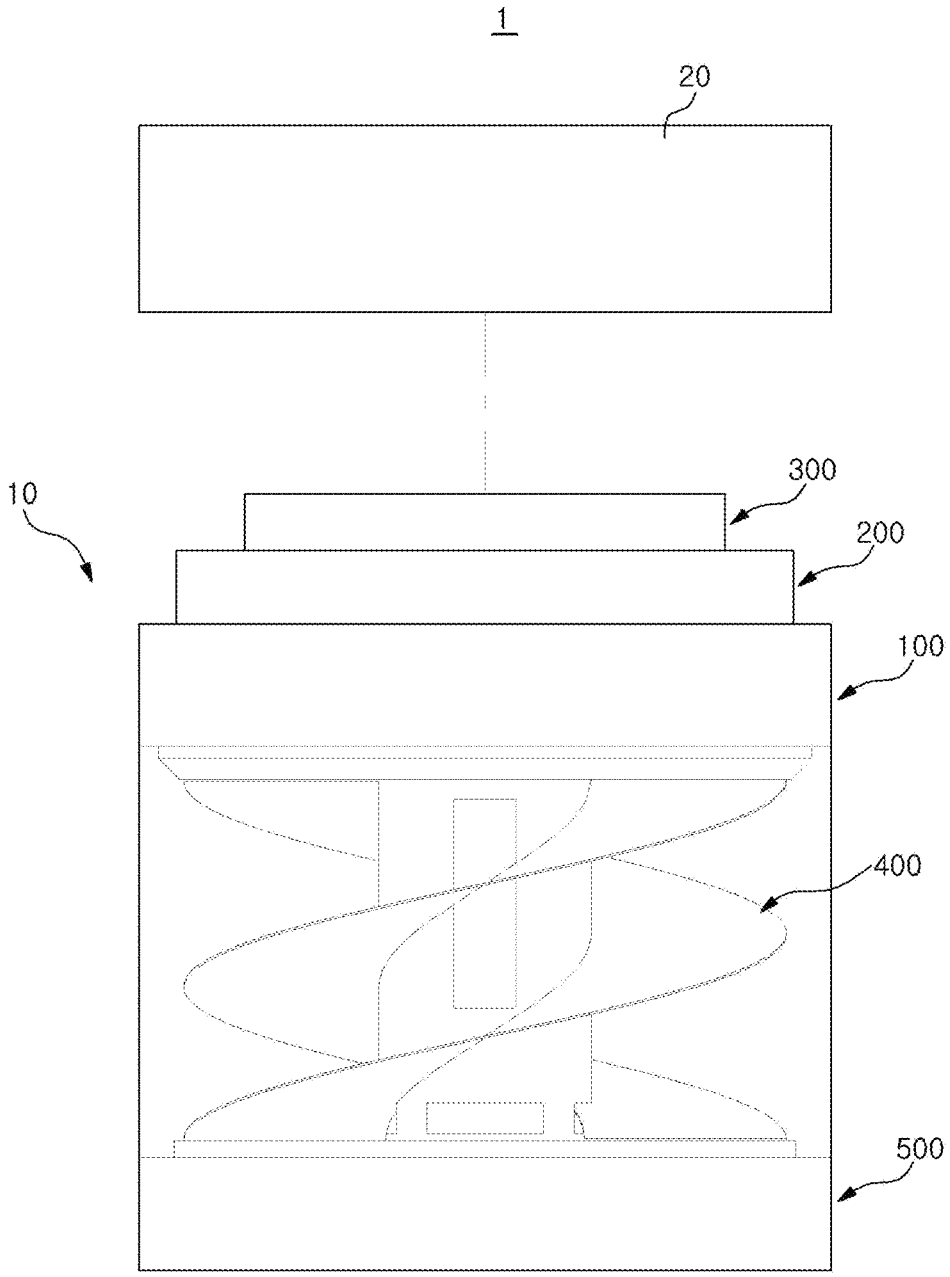

【FIG. 2】
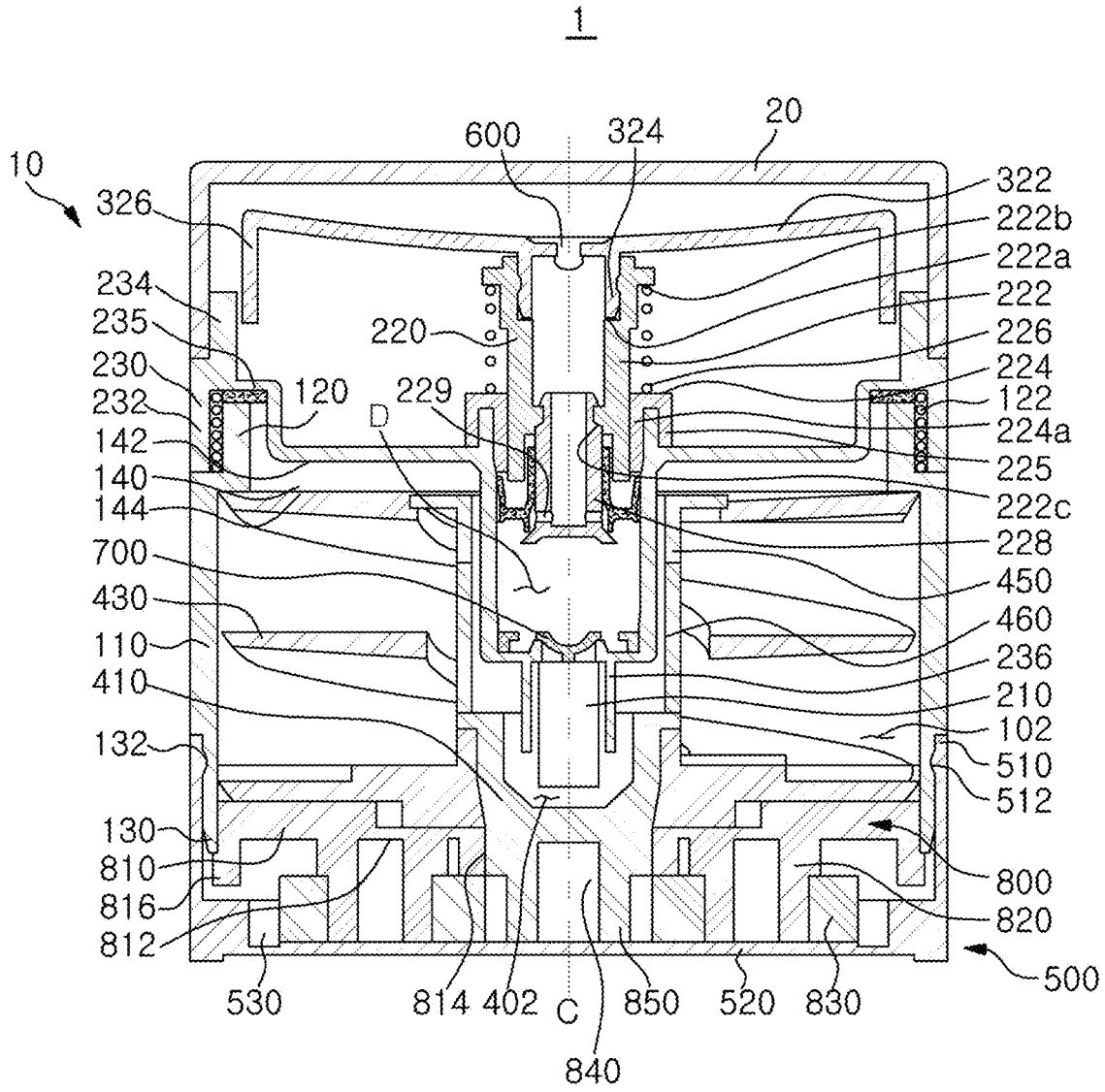

【FIG. 3】
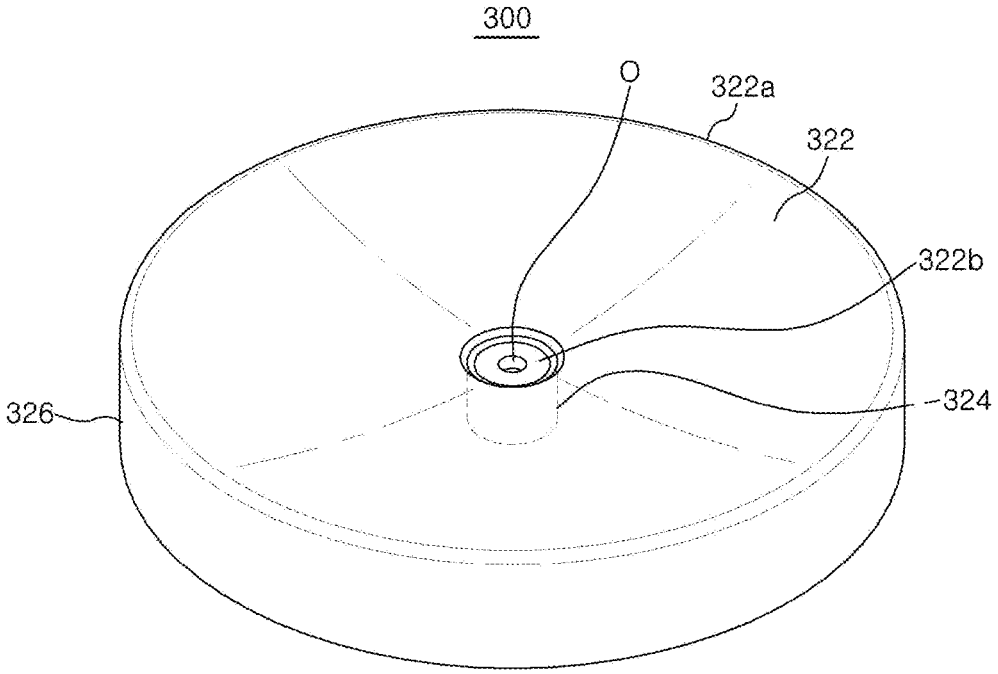

【FIG. 4】
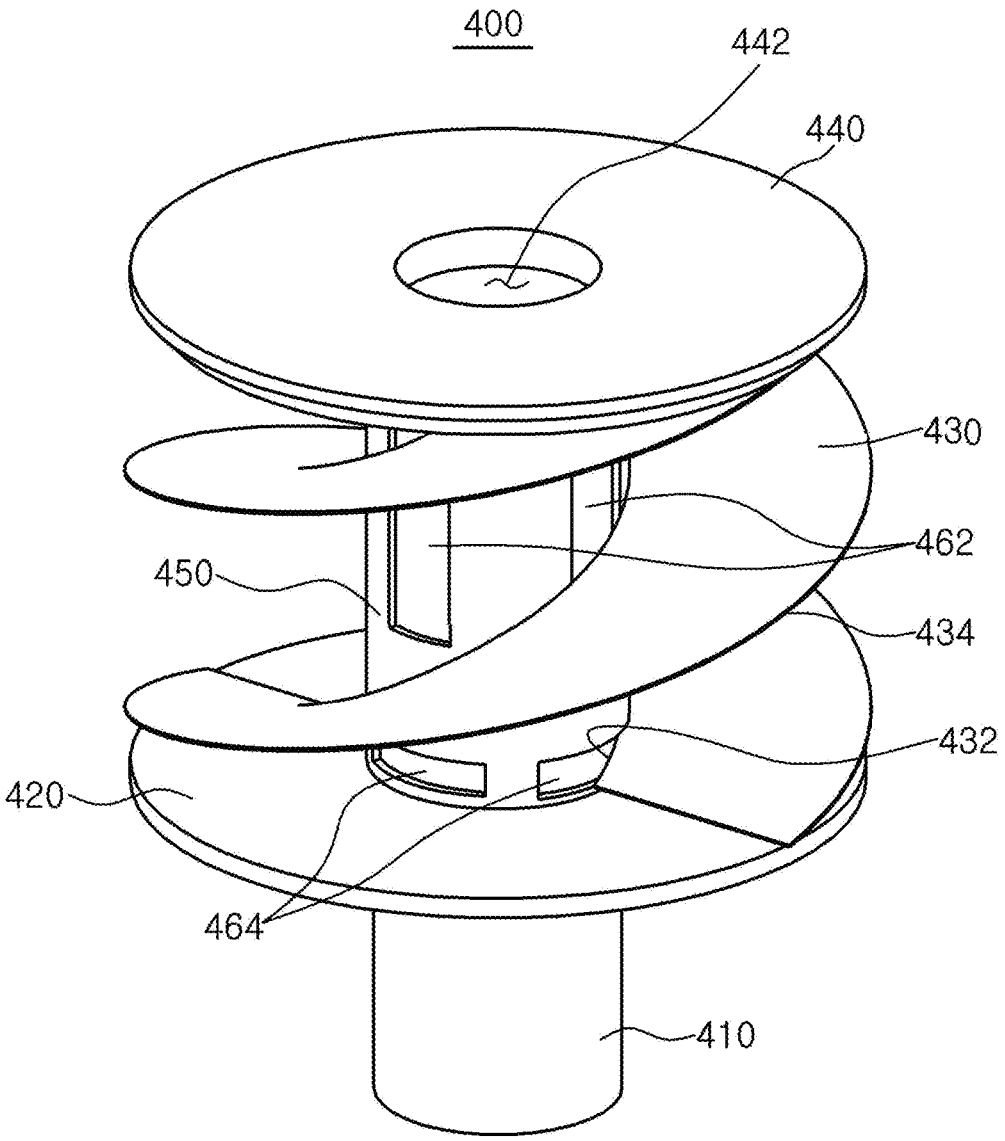

【FIG. 5】
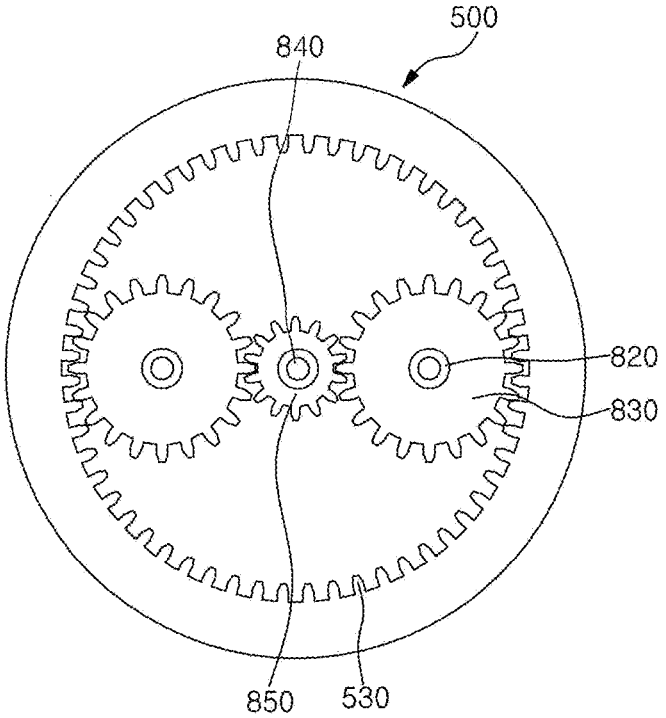

【FIG. 6】
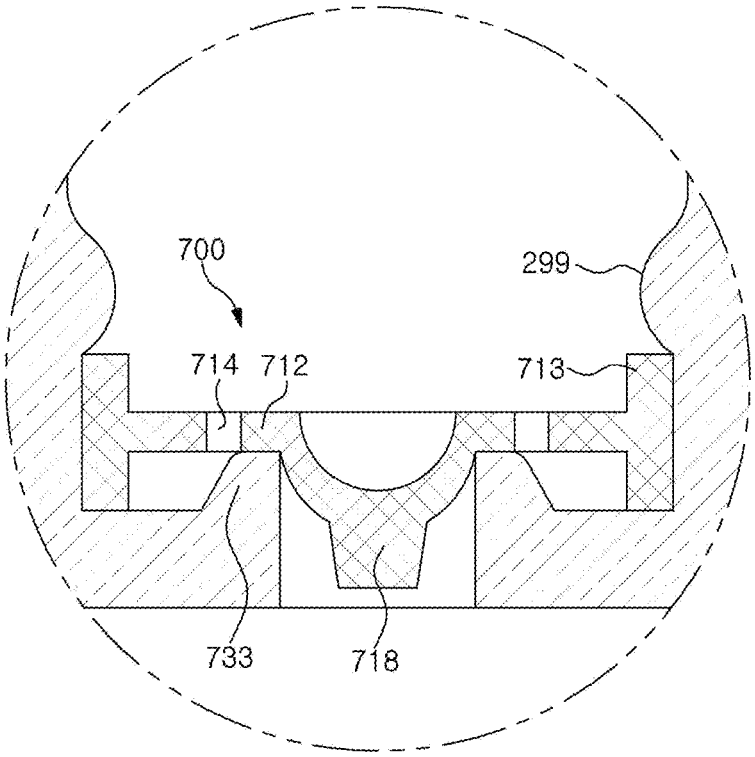

【FIG. 7】
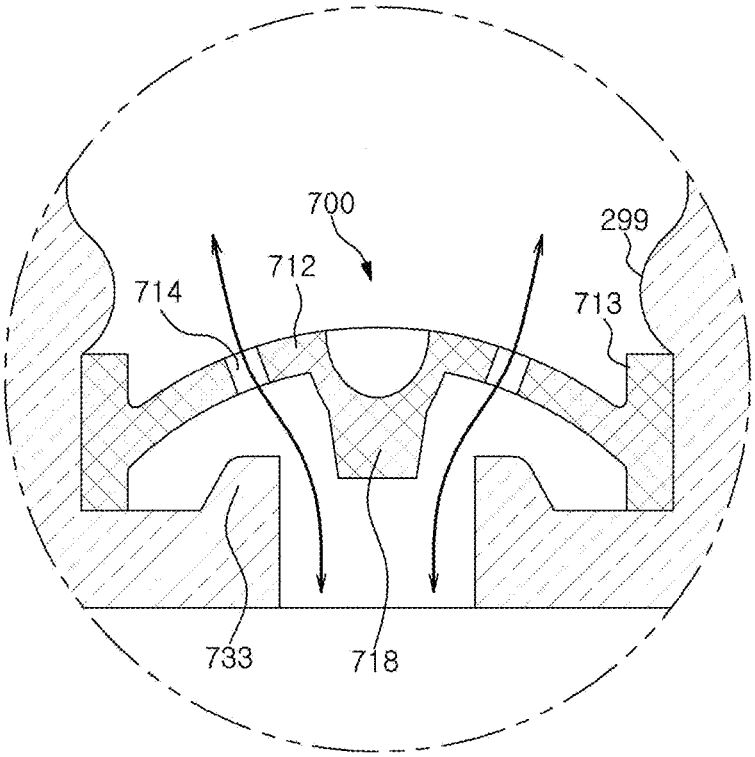

【FIG. 8】
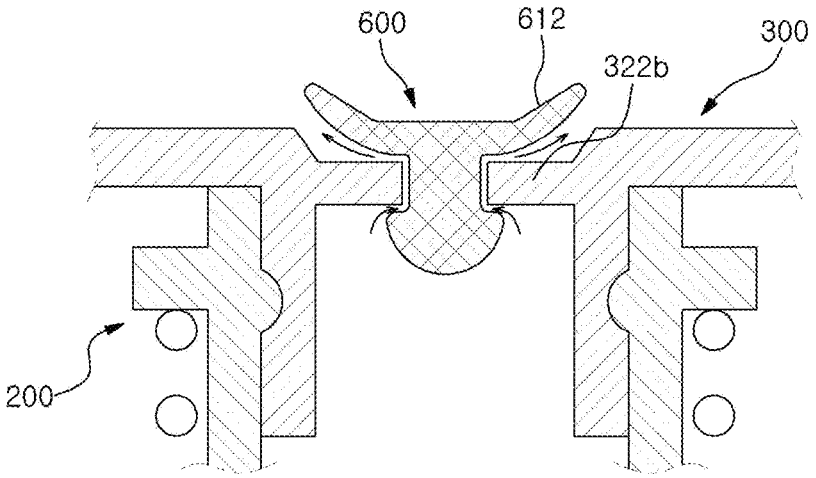

COSMETIC CONTAINER

TECHNICAL FIELD

The invention relates to a cosmetic container.

BACKGROUND

With the growing interest of people in skin care, more cream type or gel type of cosmetics having a high viscosity are launched.

In a case where a dip tube type pump is applied to a conventional cosmetic container in which a cosmetic having a high viscosity is stored, it is difficult for the cosmetic to flow into the dip tube, since the cosmetic having a high viscosity is attached to an inner wall of the container. In this case, there is a problem that cosmetic is not discharged to the outside and remained in the cosmetic container. Because of this problem, it is difficult for the conventional cosmetic container for storing a high viscosity cosmetic to employ a pump and a dip tube, and thus the high viscosity cosmetic is stored in a container having a shape of a jar and a user takes some cosmetic out of the jar-shaped container at the time of use.

However, there is a problem that the cosmetic container from which a user takes some cosmetic may cause inconvenience. Further, there is a problem that foreign matters may be entered into the cosmetic container, since a device for taking some cosmetic out of the container should be inserted into the cosmetic container.

Further, there is a problem that in a case where the cosmetic taken out of the cosmetic container needs to be mixed with other cosmetics, a separate container for mixing cosmetics is necessary.

Meanwhile, as the demand for functional cosmetic, customized cosmetic or the like increases, various cosmetic containers are suggested, which can mix cosmetics having different properties, or cosmetics having different dosage form at the time of use. For this, Korean Registered Utility Model No. 20-0464645 suggests a container which can mix cosmetic by rotating a plurality of agitating blades around a rotational axis, which are spaced apart from each other in an up and down direction.

However, as the agitating blades are spaced apart from each other in an up and down direction, there exists a region in which cosmetic is not collided with the agitating blades and thus indirectly agitated by an influence of surrounding flows. Further, it is difficult to form an agitating blade at an upper end part and a lower end part of the rotational axis, and thus these regions would also become a region where cosmetic is indirectly agitated. Accordingly, there is a problem that it is difficult to sufficiently agitate cosmetic in the entire interior of a container, or that the agitating blades should rotate more times to achieve the sufficient agitation.

Further, there exists a problem that the cosmetic attached to an inner wall surface of the container is remained thereon without being agitated not only since the agitating blades are arranged as described above, but also since radial ends of the agitating blades are spaced apart from the inner wall surface of the container. These containers, which have such function of mixing fluid therein, are usually made of a transparent material to make the function of mixing fluid therein appeal to customers. However, it will become a negative point for the design due to the fact that cosmetic is attached to the inner wall surface without being mixed. Particularly, if the cosmetic has a high viscosity, such negative point becomes more noticeable.

Further, it is also a problem that it is difficult to employ a pump to the conventional cosmetic container having a rotating blade, since the agitating blade is fixed to a rotational axle disposed at the center of the cosmetic container. Particularly, there is a problem that it is difficult to employ a dip tube, which extends to or near the bottom of the container, to the conventional cosmetic container having a rotating blade.

PRIOR ART DOCUMENTS

Patent Document

Korean Registered Utility Model No. 20-0464645 (Registered on Jan. 7, 2013)

SUMMARY

Exemplary embodiments of the invention, which have been conceived to address above-described problems, provides a cosmetic container which form a structure capable of mixing cosmetics without using a separate container for mixing cosmetic discharged to the outside.

Further, embodiments of the invention provide a cosmetic container for easily discharging cosmetic to the outside of the cosmetic container.

Further, embodiments of the invention provide a cosmetic container capable of removing a concern that foreign matter may enter into the cosmetic container.

Further, embodiments of the invention provide a cosmetic container capable of mixing cosmetic rapidly and sufficiently.

Further, embodiments of the invention provide a cosmetic container capable of preventing fluid (cosmetic) from remaining attached on an inner wall surface of the container.

Additionally, embodiments of the invention provide a cosmetic container provided with a pump and a tube extending inward.

According to an aspect of the present invention, there is provided a cosmetic container, comprising: a storing unit providing a first storing space which can store fluid; a discharging unit which discharges the fluid stored in the storing unit to the outside; and a fluid supporting unit which can support from a lower direction fluid which has been discharged to the outside.

Further, there is provided a cosmetic container, wherein the fluid supporting unit includes a first surface which has a concave shape, so that the discharged fluid can stay therein.

Further, there is provided a cosmetic container, wherein the fluid supporting unit includes a second surface which presses the discharging unit; and a third surface which moves while being guided by the discharging unit.

Further, there is provided a cosmetic container, wherein a check valve is provided, which is coupled to one side of the fluid supporting unit so as to prevent the fluid discharged to the outside from flowing backward to the storing unit.

Further, there is provided a cosmetic container, wherein a first valve is provided, which is provided at a part of the discharging unit to selectively close the discharge of fluid from the first storing space.

Further, there is provided a cosmetic container, wherein the discharging unit includes:

a tube through which the fluid stored in the storing unit is intaken; a pumping part which supports the fluid supporting unit and generates pressure for pumping the fluid stored in the storing unit; and a connecting part which connects the tube with the pumping part.

Further, there is provided a cosmetic container, wherein the pumping part includes: a first part that provides a surface which is coupled to the fluid supporting unit to support the fluid supporting unit; a second part that provides a surface on which the first part slides; and an elastic part that is provided between the first part and the second part to provide force by which the first part is relatively moved with respect to the second part.

Further, there is provided a cosmetic container, wherein on a lower side of the storing unit, a second storing space is formed, which has a concave shape, so that fluid can be collected below the tube for discharging the fluid to the outside.

Further, there is provided a cosmetic container, further comprising: a rotating unit which is provided rotatably relative to the storing unit; and a blade unit including one or more blades which rotate around a rotational axis in the first storing space by rotation of the rotating unit, wherein the second storing space is provided so as to overlap the rotational axis.

Further, there is provided a cosmetic container, wherein the blade unit includes: a central part which receives a rotating force from the rotating unit to serve as a rotational center; and an insertion part which is formed in a shape extending from the central part and surrounding the discharging unit, and wherein the second storing space is provided on the central part.

Further, there is provided a cosmetic container, wherein on a circumference of the insertion part, a cutaway portion is formed, so that fluid can flow into the second storing spaced from the first storing space.

Further, there is provided a cosmetic container, wherein the cutaway portion includes a first cutaway portion formed at an upper side of the insertion part and a second cutaway portion formed at a lower side of the insertion part, and wherein the fluid stored in the first storing space is introduced into the second storing space through at least one of the first cutaway portion and the second cutaway portion by rotation of the blade.

Further, there is provided a cosmetic container, wherein the blade unit includes: a first plate which is disposed on a lower end of the insertion part; and a second plate which is disposed on an upper end of the insertion part, and wherein the blade and the first plate rotate relative to each other, so that the fluid on the first plate can flow into the second storing space.

Further, there is provided a cosmetic container, wherein a driving force transferring unit is provided, which is provided at one side of the storing unit, and which transfers rotation of the rotating unit to the blade unit.

Further, there is provided a cosmetic container, wherein the storing unit is formed of a transparent material.

Further, there is provided a cosmetic container, wherein the storing unit has a cylindrical shape, and a diameter of the storing unit is greater than an up and down direction length of the storing unit.

According to an embodiment of the invention, there is an advantage that a cosmetic container can provide a structure capable of mixing cosmetic without using a separate container for mixing cosmetic discharged to the outside.

Further, it is an advantage that cosmetic can be easily discharged to the outside of the cosmetic container.

Further, it is also advantageous to provide a cosmetic container capable of removing a concern that foreign matter may enter into the cosmetic container.

Further, it is advantageous to be capable of mixing cosmetic rapidly and sufficiently.

Further, there is an advantageous effect of preventing fluid (cosmetic) from remaining attached on an inner wall surface of the container.

Additionally, the invention provides an advantageous effect of being provided with a pump and a tube extending inward.

BRIEF DESCRIPTION OF THE DRAWINGS

FIG. 1 is a diagram illustrating an outer appearance of a cosmetic container according to an embodiment of the invention.

FIG. 2 is a cross sectional view of the cosmetic container of FIG. 1.

FIG. 3 is a perspective view illustrating a fluid supporting unit of FIG. 1.

FIG. 4 is a perspective view illustrating a blade unit of FIG. 1.

FIG. 5 is a cross sectional view illustrating an interior of a rotating unit of FIG. 1.

FIG. 6 is a cross sectional view illustrating a closed state of a first valve of FIG. 2.

FIG. 7 is a cross sectional view illustrating an open state of the first valve of FIG. 2.

FIG. 8 is a partial cross sectional view of the fluid supporting unit illustrating a state of a check valve of FIG. 2 at the time of fluid discharge.

DETAILED DESCRIPTION

Hereinafter, specific exemplary embodiments of the invention will be described in detail with reference to the drawings.

Additionally, it is noted that when describing the invention, the detailed description for known configurations or functions may be omitted herein so as not to obscure essential points of the invention.

FIG. 1 is a diagram illustrating an outer appearance of a cosmetic container according to an embodiment of the invention, FIG. 2 is a cross sectional view of the cosmetic container of FIG. 1, FIG. 3 is a perspective view illustrating a fluid supporting unit of FIG. 1, FIG. 4 is a perspective view illustrating a blade unit of FIG. 1, FIG. 5 is a cross sectional view illustrating an interior of a rotating unit of FIG. 1, FIG. 6 is a cross sectional view illustrating a closed state of a first valve of FIG. 2, FIG. 7 is a cross sectional view illustrating an open state of the first valve of FIG. 2, and FIG. 8 is a partial cross sectional view of the fluid supporting unit illustrating a state of a check valve of FIG. 2 at the time of fluid discharge.

Referring to FIGS. 1 to 8, the cosmetic container having a function of mixing fluid therein according to an embodiment of the invention may include a storing unit 100 providing a first storing space 102 which can store fluid; a discharging unit 200 discharging to the outside the fluid which has been stored in the storing unit 100; and a fluid supporting unit 300 on which can support the fluid from its bottom, which has been discharged to the outside.

Further, according to the embodiment of the invention, it may further include a means for prompting the mixing of the fluid stored in the storing unit 100. Specifically, it may further include a rotating unit 500 which is provided relatively rotatable with respect to the storing unit 100; and a blade unit 400 which is disposed inside the storing unit 100, which is rotated around a rotational axis C in the first storing space 102 by the rotation of the rotating unit 500, and which includes one or more blades 430 extending spirally around the rotational axis C from one end to the other end of the first storing space 102.

The fluid of the embodiment of the invention may be a fluid having a high viscosity. For example, the viscosity of the fluid of the invention may range from 20,000 CPS to 30,000 CPS at a room temperature.

Further, the fluid of the embodiment may be a mixed fluid in which a first fluid and a second fluid have been mixed. For instance, the first fluid may be a W/O (water/oil) or O/W (oil/water) emulsion, and the second fluid may be a concealer. Such cosmetic prepared by the mixing of the emulsion and the concealer may exhibit various effects according to a mixing rate thereof, so a user can use a customized cosmetic product by mixing the emulsion and the concealer at a rate the user wants. However, the technical idea of the invention is not limited thereto, and the first fluid may be any fluid which can act as a solvent, while the second fluid to be mixed to it may be any substance, such as a fluid, powder or the like, which can be mixed to or dissolved in the first fluid.

In the embodiment, the storing unit 100, the discharging unit 200, the fluid supporting unit 300, the rotating unit 500, the blade unit 400 and a driving force transferring unit 800 to be described later are described by way of example as constituting the container main body 10. The container main body 10 may be combined with a lid 20, so that they may be manufactured and sold as a single cosmetic container. The lid 20 can cover the fluid supporting unit 300 so as for the fluid supporting unit not to be exposed to outside when the cosmetic container 1 is not used, and can be removably press-fitted to the discharging unit 200.

Hereinafter, for convenience of description, a direction in which the lid 20 is provided is referred to as an upper side, and a direction in which the rotating unit 500 is provided is referred to as a bottom side.

The storing unit 100 may be formed with a transparent material. In this case, a user can confirm that fluid is mixed inside the storing unit 100. Further, the user can confirm with the naked eye that different cosmetics are mixed to make a new form of a cosmetic by the manipulation of the cosmetic container 1. As a result, the user can trust the product more, while enjoying an esthetic effect.

The storing unit 100 may be formed with both ends open. Specifically, the storing unit 100 may include a tube part 110 which provides a storing and mixing space of fluid, a neck part 120 which is provided at one side of the tube part 110, and to which the discharging part 200 is coupled, and a lower storing part 130 which is provided at another side of the tube part 110, and to which the rotating unit 500 is coupled. Further, the storing unit 100 may include a reinforcement part 140 which is formed inside the neck part 120 to support the discharging unit 200.

The first storing space 102 formed by the tube part 110 may be cylindrical. With such configuration, the cosmetic can be detached from an inner wall surface of the tube part 110 by the rotation of the blade unit 400. However, the technical idea of the invention is not limited to this. For example, in the case of an embodiment where the blade unit 400 does not contact the inner wall surface of the tube part 110, the first storing space 102 may not be cylindrical. Also, the outer shape of the tube part 110 does not limit the technical idea of the invention. In the embodiment, the tube part 110 is described by way of example as being generally cylindrical.

Further, the tube part 110 may be provided in a cylindrical shape whose cross sectional area changes along a direction in which the rotational axis C of the blade part 400 extends. Specifically, the shape of the blade 430 may be changed corresponding to the change in an inner diameter of the tube part 110. For example, the width of the blade 430 may be changed corresponding to the change in the inner diameter of the tube part 110, so that the blade 430 can be kept in contact with the inner wall surface of the tube part 110.

Additionally, the tube part 110 may be formed so as to have an up and down direction length shorter than a left and right direction length (diameter). In this case, the cosmetic container 1 may be provided in a shape of a jar. Further, the tube part 110 may be provided in a variety of shapes, such as a cylindrical shape, rectangular parallelepiped or the like, and its shape is not limited.

The neck part 120 may be formed to have a diameter relatively less than that of the tube part 110, and may have a screw thread 122 around itself, so that it can be coupled to the discharging part 200. As this screw thread 122 is formed, the connecting part 230 can be detached from the storing unit 100 by rotating the connecting part 230 relative to the neck part 120. In this case, the fluid contained in the storing unit 100 can be easily substituted. In the embodiment, the screw engagement is described by way of example as a method for coupling the discharging unit 200 to the storing unit 100, but the technical idea of the invention is not limited to this, and may include a press fitting method.

The lower storing part 130 may rotatably support the rotating unit 500. For example, the lower storing part 130 may be a cylinder shape inserted into the inner space of the rotating unit 500. Further, the lower storing part 130 may have an aperture shape into which the driving force transferring part 800 can be inserted. On a circumference of the lower storing part 130, there may be formed an inner projected part 132 which fixes the rotating unit 500 and at the same time rotatably supports the rotating unit 500. The inner projected part 132 and the outer projected part 512 will be described in detail later.

The reinforcement part 140 may include an upper surface 142 which supports the discharging unit 200 at the upper side, and a lower surface 144 on which the blade unit 400 to be described later slides. Further, the reinforcement part 140 may be formed integrally with the neck part 120.

The discharging unit 200 is a means of discharging a mixed fluid or a fluid stored in the first container 100. The fluid discharged from the discharging unit 200 may fill the fluid supporting unit 300 like a pond.

The discharging unit 200 may include a tube 210 through which the fluid stored in the storing unit 100 is intaken; a pumping part 220 which supports the fluid supporting unit 300, and which generates pressure for pumping the fluid stored in the storing unit 100; and the connecting part 230 which connects the tube 210 and the pumping part 220.

The tube 210 may extend to the lower side of the storing unit 100. That is, the tube 210 may serve as a dip tube.

The pumping part 220 is a means of generating pressure for pumping the fluid stored in the storing unit 100. The pumping part 220 may include a first part 222 which is coupled to the fluid supporting unit 300 to support the fluid supporting part 300; a second part 224 providing a surface on which the first part 222 slides; and an elastic part 226 provided between the first part 222 and the second part 224.

The first part 222 may include a first projected part **222*a* for supporting a part of the fluid supporting unit 300. For example, in a case where an external force is applied downwards to the fluid supporting unit 300, the fluid supporting unit 300 and the first part 222 can be moved downward, since the part of the fluid supporting unit 300 is caught by the first projected part 222*a*. At this time, the fluid supporting part 300 may be press fitted into the first part 222. However, the technical idea is not limited to this, and the first part 222 and the fluid supporting unit 300** may be coupled to each other by forming a screw thread therebetween.

On the outer side of the first part 222, a second projected part 222*b* may be formed by which the elastic part 226 can be caught. In the embodiment of the invention, the elastic part 226 will be described by way of example as being a spring.

Further, the inner side of the first part 222 may be provided with a third projected part 222*c* to which a pressure member 228 is coupled. In this case, the pressure member 228 coupled to the third projected part 222*c* may be moved downwards to generate pressure for pumping the fluid.

On a side surface of the pressure member 228, there may be provided a hole 229 through which the fluid stored in a storing chamber D is moved towards a check valve 600.

The elastic part 226 is caught by the second projected part 222*b*, and the compressive force of the elastic part 226 is applied to the second projected part 222*b*, so that the fluid supporting unit 300 can be returned back to its original position by the returning force of the elastic part 226.

The second part 224 may include the sliding surface 224*a* on which the first part 222 can slide; and a coupling part 225 which can be coupled to the connecting part 230.

The coupling part 225 may have a shape bent at 90 degrees into which the connecting part 230 can be press fitted. In a case where the coupling part 225 is formed so as to have such a bent shape, the second part 224 and the connecting part 230 can be coupled firmly to each other.

The elastic part 226 may be provided between the first part 222 and the second part 224 to provide an elastic force for returning the first part 222 to its original condition. When the first part 222 is returned to its original condition, the fluid supporting part 300 coupled thereto is also returned to its original condition.

The connecting part 230 may connect the tube 210 with the pumping part 220, and may provide the storing chamber D between the tube 210 and the pumping part 220. Further, the connecting part 230 may provide portions which can couple the storing unit 100, the pumping part 220, the fluid supporting unit 300 and the lid 20 at the same time.

For instance, the connecting part 230 may be provided with the first connecting part 232 for being coupled to the neck part 120 of the storing unit 100. Further, the connecting part 230 may be provided with the second connecting part 234 to which the lid 20 and the fluid supporting part 300 are coupled. Herein, the lid 20 is coupled to the outer side of the second coupling part 234, while the fluid supporting unit 300 is disposed slidably inside the second coupling part 234. A part of the fluid supporting unit 300 may contact the inner side of the second coupling part 234 so as to move slidably thereon. Further, the lower side of the connecting part 230 may be provided with the third coupling part 236 to which the tube 210 can be coupled. Herein, the third coupling part 236 and the tube 210 may be coupled to each other by the press fitting, but the technical idea of the invention is not limited to this, and the coupling means may include all known means.

The connecting part 230 may be provided with a movement restricting part 235 which is formed for restricting the downward movement of the fluid supporting unit 300. That is, a lower end of a third surface 326 of the fluid supporting part 300 is caught by the movement restricting part 235, and thus the fluid supporting unit 300 cannot move downward even though the external force continues to be applied. Further, in a case where no external force is applied to the fluid supporting unit 300, the movement restricting part 235 and the lower part of the third surface 326 of the fluid supporting unit 300 are spaced apart from each other.

The fluid supporting unit 300 may include a first surface 322 which has a concave shape, so that the discharged fluid can stay therein.

The outer circumference 322*a* of the first surface 322 may be positioned higher than a center O of the first surface 322. Further, at the center O of the first surface 322, a check valve fitting part 322*b* may be formed in which the check valve 600 is positioned, and the outer circumference 322*a* may be formed at an upper side than the check valve fitting part 322*b*. As described above, the first surface 322 is formed in a concave shape, and thus there may be provided a space on the first surface 322 where the fluid which has been discharged to the outside of the storing unit 100 can stay.

After discharging the fluid on the first surface 322, a user may mix another fluid with the discharged fluid on the first surface 322. When the cosmetic container 1 is formed in a shape of a jar, the first surface 322 can provide a greater surface area where the discharged fluid and another fluid can be mixed.

Further, the fluid supporting unit 300 may include a second surface 324 which is connected to the discharging unit 200, and the third surface 326 which slides on the discharging unit 200.

The second surface 324 may be coupled to the first part 222 of the discharging unit 200. For example, after forming the second surface 324 in a cylindrical shape, the second surface 324 may be press fitted into the first part 222.

Further, as the lower side of the second surface 324 is caught by the first projected part 222*a*, the second surface 324 can press the discharging unit 200 when an external force is applied to the fluid supporting unit 300 downwards.

The third surface 326 may be formed so as to be extended from the outer circumference 322*a* of the first surface 322. Further, when an external force is applied to the fluid supporting unit 300 downwards, the third surface 326 may be moved while being guided by the discharging unit 200. For example, when an external force is applied to the fluid supporting unit 300 downwards, the third surface 326 may be moved while being guided by the second coupling part 234 of the discharging unit 200. In this case, the third surface 326 facing the second coupling part 234 may be formed smoothly so as to reduce friction therebetween.

The cosmetic container 1 having a function of mixing fluid therein according to an embodiment of the invention may agitate contents stored in the storing unit 100 by rotating a rotatable blade structure in the storing unit 100. Herein, the cosmetic container 1 may be a container which stores a cream type of cosmetic.

The blade unit 400 may mix the fluid provided into the first storing space 102 with other substance while rotating inside the storing unit 100. Specifically, the blade unit 400 may include one or more blades 430 which enable fluid and other substance to flow, and which may collide directly against them.

The blade 430 may be disposed so as to rotate around the rotational axis C within the first storing space 102. Herein, the rotational axis C may be an imaginary line generated by extending a central line of a rotational axle 840 which rotates the blade unit 400, and may be provided in a form extending in an up and down direction of the storing unit 100. Herein, the blade 430 may be disposed so as not to interfere with a region where the tube 210 is provided (a central region of the first storing space 102). Further, the blade 430 may be formed so as to rotate around the tube 210.

In this embodiment, two blades 430 are shown by way of example as extending spirally in an up and down direction. Herein, one blade 430 may be formed to extend from a lower end to an upper end while being wound once around the rotational axis C. That is, when viewed from the top, start and end points of one blade 430 may be disposed at the same point.

Further, a plurality of blades 430 may extend symmetrically around the rotational axis C. In this case, fluid mixing can be uniformly performed within the first storing space 102.

Further, the blade 430 may be supported by a first plate 420 which is rotated by the rotating unit 500, and by a second plate 440 which is spaced away from the first plate 420 by a predetermined distance while facing the first plate 420. Herein, the second plate 440 may be optionally provided, but preferably it is provided for robust support of the blade 430. The first plate 420 and the second plate 440 will be described in detail later.

The blade unit 400 may include a central part 410 which receives a rotating force of the rotating unit 500, and which serves as a rotational center, and an insertion part 450 which extends from the central part 410, and which surrounds a part of the discharging unit 200 (e.g., the tube 210). Herein, the blade 430 may be disposed on the circumference of the insertion part 450, and the tube 210 may be disposed inside the insertion part 450.

The central part 410 may be understood as the rotational center of the blade unit 400. Specifically, the central part 410 may be rotated together with the rotational axle 840 while being fixed to the rotational axle 840 to which the rotating force is transferred from the rotating unit 500. The central part 410 may be provided on the rotating unit 500 side of the storing unit 100, and the insertion part 450 may be formed so as to extend from the central part 410 to the discharging unit 200.

Further, at a lower side of the central part 410 or at a central part of the first plate 420, a second storing space 402 may be formed in which the fluid stored in the storing unit 100 can be collected. In a case where only small amount of the fluid (cosmetic) is remained in the cosmetic container 1, the fluid may be collected in the second storing space 402, and then it can be discharged to the outside through the tube 210. In this case, the remainder quantity of the fluid remained in the storing unit 100 can be minimized.

The insertion part 450 may be provided so as to rotate together with the central part 410 while at the same time providing a space into which the discharging unit 200 can be fitted.

There may be provided a predetermined distance between the inner circumferential surface of the insertion part 450 and the tube 210 so that the inner circumferential surface of the insertion part 450 and the tube 210 do not contact each other, and thus the tube 210 cannot not be affected by the rotation of the blade unit 400.

At a side surface of the insertion part 450, a cutaway portion 460 may be formed such that the fluid in the storing unit 100 can be collected in the second storing space (402) where the tube 210 is positioned.

The cutaway portion 460 may be formed by cutting a part of the insertion part 450, and may be disposed along the circumference of the insertion part 450 at a certain interval.

The cutaway portion 460 may include a first cutaway portion 462 formed at the upper side of the blade unit 400 (e.g., a side near the second plate 440), and a second cutaway portion 464 formed at the lower side of the blade unit 400 (e.g., a side near the first plate 420). The first cutaway portion 462 and the second cutaway portion 464 may be disposed along the circumference of the insertion part 450 at a certain interval.

Further, the second cutaway portion 464 may be formed in 80% to 95% of the lower side circumference of the insertion part 450. That is, on the lower side of the insertion part 450, a wide range of passage or space may be provided, so that the fluid stored in the first storing space 102 can enter into the second storing space 402. With a configuration as described above, even when the remainder quantity of the fluid in the storing unit is less than 5%, the fluid can be collected in the second storing space 402 below the tube 210, and thus the remainder quantity which a user cannot use can be minimized.

Further, when the discharging unit 200 is coupled to the storing unit 100, an upper end of the insertion part 450 can be opened in order to insert the tube 210 into the insertion part 450. At this time, in order to guide the insertion of the tube 210 stably, at the opened end of the insertion part 450, an inserting guide part (not shown) may be provided, which is formed with a greater diameter than that of the insertion part 450 for guiding the insertion of the tube 210. On the insertion guide part, a slit, a cutaway portion, may be further formed, which can impart irregularity to fluid flow formed by the rotation of the blade 430.

Further, the blade unit 400 may include the first plate 420 which is connected to the central part 410 so as to be disposed at one side of the first storing space 102, and which has a plate shape, and the second plate 440 which is provided with a tube insertion hole 442 for insertion of the tube 210, which is connected to the insertion part 450 so as to be disposed at the other side of the storing space 102, and which has a plate shape. And one side of the blade 430 may be connected to the first plate 420, while the other side thereof may be connected to the second plate 440.

Specifically, the first plate 420 may be formed in a shape of a plate which is disposed adjacent to the rotating unit 500 while transversing the storing space 102. Further, a pair of the blades 430 may be disposed symmetrically on one side and the other side of the first plate 420, respectively. The plurality of blades 430 may extend symmetrically around the rotational axis C from the first plate 420 to the second plate 440 in a spiral shape.

The blade 430 may be continuously formed between the first plate 420 and the second plate 440, so that continuous spiral fluid flow can be produced. Further, as the blade 430 has such a configuration as described above, entire agitation of the flow can be performed in an up and down direction region of the first storing space 102 in which the blade 430 is formed.

Further, in the embodiment of the invention, the first plate 420 and the second plate 440 are described by way of example as rotating at the same time, but the present invention is not limited to this. For example, the first plate 420 may not rotate, while only the second plate 440, and the blade 430 and the insertion part 450 attached to the second plate may rotate. In this case, by the help of the lower end of the blade 430, the fluid on the first plate 420 can be pushed into the second storing space 402.

The first plate 420 may be rotated while being seated on a base 810 to be described later, which constitutes the one side surface of the first storing space 102. The second plate 440 may be formed so as to be adjacent to the neck part 120 and the reinforcement part 140, that is, a mouth of the first storing space 102. For example, a distance between the second plate 440 and a point where the neck part 120 is connected to the tube part 110 may be within 10% of the total length of the first storing space 102. In this case, the blade unit 400 may be formed over a section corresponding to 90% of the first storing space 102, so the blade unit 400 can agitate a fluid within the entire first storing space 102.

In the embodiment, the blade 430 of the blade unit 400 may be formed over 50% or more of the total length of the first storing space 102 for the entire fluid agitation in the first storing space 102. Further, the position of the first plate 420 is not limited to a case where it is seated on the base 810, and it may be disposed at any position within the first storing space 102 to support the blade 430.

The blade 430 may be provided in a shape of a blade having a predetermined width, and may generate a flow by colliding against a fluid or pushing a fluid between the first plate 420 and the second plate 440. At this time, an inner edge 432 of the blade 430 may include a portion spaced away from the insertion part 450. Further, at least a part of an outer edge 434 of the blade 430 may contact the inner wall surface of the storing unit 100 and move slidably with respect to it.

In this embodiment, the inner edge 432 of the blade 430 is described as being spaced apart from the insertion part 450, and the outer edge 434 is described as contacting the inner wall surface of the tube part 110, but the technical idea of the invention is not limited to this. For example, a part (an inner edge 432) of the blade 430 may be connected to the insertion part 450. In this case, the structural strength of the blade 430 can be supplemented, and irregularity can be imparted to fluid flow moving in an up and down direction of the first storing space 102, thus improving the agitation effect.

Further, in the embodiment of the invention, the inner edge 432 may be formed at a relatively lower position when compared to the outer edge 434. Specifically, the blade 430 may be formed so as to slope down from the outer edge 434 side to the inner edge 432 side. In this case, the fluid can flow from the outer edge 434 to the inner edge 432, and then the fluid can flow into the second storing space 402.

In a case where the blade unit 400 is provided as in the embodiment, a spiral fluid flow can be formed by the blade 430, and such fluid flow can be mixed in an up and down direction through a space between the inner edge 432 and the insertion part 450. Further, the outer edge 434 of the blade 430 may sweep from an inner wall surface of the storing unit 100 fluid or other substance which may be attached thereto and remained thereon. In this case, the inner wall surface of the storing unit 100 can be always kept clean.

Herein, the blade 430 may be formed of a material having a strength lower than that of the storing unit 100, in order to prevent scratches on the storing unit 100. By way of an example, the storing unit 100 may be formed of transparent PETG, and the blade 430 may be formed of polypropylene.

Meanwhile, as another example, the outer edge 434 of the blade 430 may contact the inner wall surface of the storing unit 100, and be formed of a soft material. In this case, the blade 430 may be in a shape of a wiper which sweeps off the inner wall surface of the storing unit 100. The blade 430 having a shape of a wiper may move slidably on the inner wall surface of the storing unit 100, and be formed of a low friction material, such as Teflon, in order to minimize damage on the inner wall surface.

In this embodiment, the outer edge 434 is described by way of example as contacting the inner wall surface of the storing unit 100, but the technical idea of the invention is not limited to this. For example, the outer edge 434 may be disposed so as to be spaced apart from the inner wall surface of the storing unit 100 by a predetermined distance. That is, the width of the blade 430 may be set such that the blade 430 can rotate while being spaced apart from the inner wall surface of the storing unit 100. At this time, the distance between the outer edge 434 of the blade 430 and the inner wall surface of the storing unit 100 may be set such that the fluid flow can generate pressure enough to detach the fluid and other substance from the inner wall surface of the storing unit 100. For example, the distance between the outer edge 434 of the blade 430 and the inner wall surface of the storing unit 100 may be set to be 1 mm or less.

Further, according to properties of fluids to be mixed, the first fluid, the second fluid and mixture thereof may not be attached to the inner wall surface of the storing unit 100. Further, the outer edge 434 of the blade 430 may be designed to be sufficiently spaced apart from the inner wall surface of the storing unit 100. In this case, fluid flow may be generated in an up and down direction between the outer edge 434 of the blade 430 and the inner wall surface of the storing unit 100, so that the fluid can be mixed more smoothly.

Meanwhile, the insertion part 450, which may serve to connect the first plate 420 with the second plate 440, may serve as a rotational axle of the blade unit 400. Therefore, the insertion part 450 may be referred to as a rotational axle part.

Meanwhile, on one side of the storing unit 100, the driving force transferring part 800 may be provided for transferring the rotation of the rotating part 500 to the blade unit 400. In this embodiment, the driving force transferring part 800 is described by way of example as providing a predetermined gear assembly, but the technical idea of the invention is not limited to this, and various known rotating force transferring devices, such as a belt, a chain, a roller and the like, may be used.

Specifically, the driving force transferring part 800 may include the base 810 which is coupled to one side of the storing unit 100 so as to close one-side opening of the storing unit 100, and the blade unit 400 may be rotatably coupled to the base 810. The base 810 may have such a configuration and an area that it can be inserted into the lower storing part 130 to close the open space. That is, the one side of the storing unit 100 may be closed by the base 810, and thereby the first storing space 102 can be formed.

On an upper surface of the base 810, a rotation supporting part 812 may be formed for slidably and rotatably supporting a part of the bottom surface of the first plate 420. As an example, the rotation supporting part 812 may be a groove into which a protruding region formed on the bottom surface of the first plate 420 may be inserted.

In a central portion of the base 810, more specifically, a central portion of the rotation supporting part 812, a through hole 814 may be formed into which the central part 410 of the blade unit 400 may be inserted. The central part 410 may be connected to the rotational axle 840 through the through hole 814. That is, the blade unit 400 may be rotatably coupled to the base 810.

Further, on a circumference of the base 810, a receiving portion 816 may be provided on which the lower storing part 130 may be seated and supported. The receiving portion 816 may support the end of the lower storing part 130 while pressing it. Further, the rotating unit 500 may be coupled to the lower storing part 130, and press a connecting gear rotational axle 820 formed on the base 810.

The rotating unit 500 may surround the base 810 and the lower storing part 130, and be rotatably coupled to the lower storing part 130. A user may rotate the blade unit 400 by relatively rotating the rotating unit 500 with respect to the storing unit 100, and by such action, the fluid provided in the first storing part 102 may be mixed.

Specifically, the rotating unit 500 may include a housing part 510 which surrounds the lower storing part 130, and a bottom part 520 which forms a bottom surface of the container main body 10. At this time, on an outer circumferential surface of the lower storing part 130, an inner projected part 132 may be formed, and on an inner circumferential surface of the housing part 510, an outer projected part 512 may be formed. The outer projected part 512 is caught by the inner projected part 132, so that the rotating unit 500 can be fixed to the storing unit 100.

The outer projected part 512 slides along the inner projected part 132, and thus the rotating unit 500 can relatively rotate with respect to the storing unit 100. For example, the inner projected part 132 and the outer projected part 512 may be protrusions projected in a ring shape, respectively. By pressing the rotating part 500 toward the storing unit 100, the lower storing part 130 and the housing part 510 may be elastically deformed to a certain extent, so that the outer projected part 512 can move over the inner projected part 132 to be caught by the inner projected part 132. As a result, the rotating unit 500 may be fixed to the storing unit 100. In this case, the outer projected part 512 may be brought into contact with and slid on the inner projected part 132. Further, the rotating unit 500 may be relatively rotated with respect to the storing unit 100 at a predetermined position.

Meanwhile, the bottom part 520 may press the connecting gear rotational axle 820 formed on the base 810. Therefore, the base 810 may be pressed upwards, and then it may press the end of the lower storing part 130. As a result, the base 810 may be firmly maintained at a position where it is inserted into the lower storing part 130. In the embodiment, the base 810 is described by way of example as being fixed by being pressed by the lower storing part 130 and the rotating unit 500, but the base 810 may be adhesively fixed or press-fit fixed to the lower storing part 130.

On the base 810, the rotational axle 840, which becomes a rotational center of the blade unit 400, and a center gear 850 coupled to the rotational axle 840 may be provided. Inside the rotating unit 500, a main gear 530 may be formed along an inner circumferential surface of the rotating unit 500. Further, in the base 810, at least one connecting gear 830 may be provided which transfers rotating force of the main gear 530 to the center gear 850.

As described above, the rotational axle 840 may be fixed to the central part 410, and the center gear 850 may rotate the rotational axle 840 by means of the rotation of the main gear 530.

The connecting gear 830 may be fixed to the connecting gear rotational axle 820 extending downward from the base 810, and may be provided plural in number around the center gear 850. This connecting gear 830 may serve to transfer the rotating force of the main gear 530 to the center gear 850. At this time, the main gear 530, the connecting gear 830 and the center gear 850 may be formed with such a gear ratio that the rotational axle 840 can have a rotation number greater than that of the rotation unit 500. That is, the center gear 850 may rotate more than one time for one rotation of the rotating unit 500, and thereby the blade unit 400 may rotate more times than the rotation unit 500. As a result, even though a user exerts a small amount of force to the rotating unit 500, the fluid can be easily mixed. In the embodiment, the connecting gear 830 is shown by way of example as being provided in a pair at both sides of the center gear 850, but the technical idea of the invention is not limited to this.

Further, the cosmetic container 1 according to the embodiment of the invention may include the first valve 700, which is coupled to a part of the discharging unit 200 to selectively close the fluid discharge from the first storing space 102 to the storing chamber D. Specifically, the first valve 700 may be disposed between the connecting part 230 and tube 210.

The first valve 700 may move the fluid to the discharging unit 200 by means of the pressure change at one side and the other side of the first valve 700 (an upper side and a lower side in the drawing) while being fixed by a seat rib 733 (see FIGS. 6 and 7).

The first valve 700 may be formed of a material having such an elasticity that it can be deformed according to the pressure change of the upper side and the lower side thereof. Specifically, the first valve 700 may include a closing surface 712 which can be deformed, one or more holes 714 which are formed in the closing surface 712, and through which fluid can flow, and a supporting part 713 which is formed at a peripheral portion of the closing surface 712 to support the closing surface 712.

At this time, on the closing surface 712, a load 718 may be provided in order to close the tube 210 completely. For example, the load 718 may be formed so as to have a hemisphere shape inserted toward the tube 210 to a predetermined depth.

When the first valve 700 is in a static position, the closing surface 712 may be in contact with the seat rib 733, and the hole 714 may be disposed outside the inner boundary of the seat rib 733.

Further, the closing surface 712 may be deformed according to the pressure change of the upper side and lower side of the first valve 700. Specifically, when the pressure at the upper side of the first valve 700 (the upper side in the drawing) becomes higher relatively, the first valve 700 receives downward pressure, and the closing surface 712 becomes in close contact to the seat rib 733 as shown in FIG. 6.

On the other hand, when the pressure at the lower side of the first valve 700 (the lower side in the drawing) becomes higher relatively, the first valve 700 receives upward pressure, and the closing surface 712 may be deformed as shown in FIG. 7. As the closing surface 712 is moved upward, a space is formed between the closing surface 712 and the seat rib 733, and fluid may flow into this space and then pass through the hole 714 to the upper side.

Inside the connecting part 230, a fixing protrusion 299 may be provided in order to prevent detachment of the supporting part 713 which has been seated into the connecting part 230.

The check valve 600 may have a first state in which it is in close contact with the fluid supporting unit 300, and a second state in which it is partially or entirely spaced apart from the fluid supporting unit 300. In a case where pressure for pumping the fluid stored in the first storing space 102 is applied to the discharging unit 200, the check valve 600 may be changed from the first state to the second state. The state of the check valve 600 shown in FIG. 2 can be understood as the first state in which the check valve is in close contact with the fluid supporting unit 300, and when the first valve 700 is closed as shown in FIG. 6, the check valve 600 may be in the first state.

Further, the state of the check valve 600 shown in FIG. 8 can be understood as the second state in which the check valve is spaced apart from the fluid supporting unit 300, and when the first valve 700 is opened as shown in FIG. 7, the check valve 600 may be in the second state.

When no external force is applied to the discharging unit 200, the check valve 600 is positioned in the first state, and thus can prevent fluid from flowing backward from the fluid supporting unit 300 to the first storing space 102. Specifically, when the check valve 600 is positioned in the first state, an outer circumference 612 of the check valve 600 can be in close contact with a check valve fitting part 322*b* of the fluid supporting unit 300.

When external force is applied to the discharging unit 200, the check valve 600 is positioned in the second state, and thus fluid can be discharged from the first storing space 102 to the fluid supporting unit 300. Specifically, when the check valve 600 is positioned in the second state, the outer circumference 612 of the check valve 600 can be separated from the check valve fitting part 322*b* of the fluid supporting unit 300.

Hereinafter, operation and effect of the cosmetic container 1 according to an embodiment having such a configuration as described above will be described.

First, the container main body 10 is assembled as below.

At first, the blade unit 400 is coupled to the driving force transferring unit 800. At this time, the center part 410 of the blade unit 400 may be inserted into the through hole 814 from the one side of the base 810, and the rotational axle 840 may be coupled and fixed to the center part 410.

The center gear 850 may be coupled to the rotational axle 840. The blade unit 400 may be rotatably fixed to the base 810 by the center gear 850 being coupled to the rotational axle 840.

After that, the connecting gear 830 may be inserted into the connecting gear rotational axle 820 of the base 810 so as to operate with the center gear 850.

An assembler may put the assembly of the blade unit 400 and the driving force transferring unit 800 into the first storing space 102 of the storing unit 100 through the lower storing part 130. At this time, the insertion depth of the assembly may be limited by the receiving portion 816 formed on the base 810 being caught by the end of the lower storing part 130. The base 810 may close the one side of the first storing space 102 by being inserted into the lower storing part 130.

After that, the assembler may fit the lower storing part 130 into the rotating unit 500. At this time, the outer projected part 512 may be coupled in a hook-like engagement to the inner projected part 132, and thereby the rotating unit 500 may be relatively rotatably fixed to the storing unit 100. Besides, the main gear 530 formed on the inner circumferential surface of the rotating unit 500 may be disposed so as to operate with the connecting gear 830 and the center gear 850.

At this state, predetermined fluid may be injected into the storing unit 100 through the neck part 120, and then the discharging unit 200 may be coupled to the storing unit 100. At this time, the discharging unit 200 may be assembled, such that the tube 210 can be inserted into the insertion part 450 of the blade unit 400, and the tube 210 may be stably positioned in the insertion part 450.

The container main body 10 may be assembled completely as described above and combined with a lid 20, so that they may be sold as the single cosmetic container 1.

After purchasing this cosmetic container 1, the user may remove the discharging unit 200 from the storing unit 100, and put into the storing unit 100 through the neck part 120 a substance which the user wants to mix. Although this embodiment exemplifies that the user puts into the storing unit 100 a substance which the user wants to mix after removing the discharging unit 200 from the storing unit 100, it may be also possible to put into the storing unit 100 a substance which the user wants to mix while the discharging unit 200 is fixed to the storing unit 100 according to an embodiment. Further, the storing unit 100 may be provided to a user with mixed substances stored therein. That is, a method of storing a substance to be mixed with fluid in the storing unit 100 does not limit the technical idea of the invention.

The user may close the storing unit 100 using a method of coupling the discharging unit 200 after putting in the storing unit 100 fluid and other substance to be mixed with the fluid. And, the user may relatively rotate the rotating unit 500 with respect to the storing unit 100. For example, the user may rotate the rotating unit 500 with one hand while fixing the storing unit 100 with the other hand.

At this time, the main gear 530, the connecting gear 830 and the center gear 850 are operated together, so that the user may rotate the blade unit 400 at a rotation number greater than that of the rotating unit 500.

Meanwhile, after fluid is discharged to the fluid supporting unit 300, the user may mix and use the discharged fluid and other fluid on a broad surface of the fluid supporting unit 300.

In addition, as fluid may be collected to the second storing space 402 and discharged through the tube 210 to the outside, the remainder quantity of the fluid remained in the storing unit 100 can be minimized.

On the lower side of the insertion part 450, a passage or a space may be provided, so that the fluid stored in the first storing space 102 can enter into the second storing space 402. With such a configuration as described above, even when the remainder quantity of the fluid in the storing unit is less than 5%, the fluid can be collected in the second storing space 402 below the tube 210.

Further, the cosmetic container 1 according to an embodiment of the invention may have a function of mixing fluid therein. Specifically, the cosmetic container 1 may agitate contents stored in the storing unit 100 by forming a rotatable blade structure in the storing unit 100 and rotating it. At this time, the cosmetic container 1 may be a container having a shape of a jar, which stores a cream type of cosmetic.

The blade 430 formed in the blade unit 400 has a shape extending continuously and spirally from one side to the other side of the storing unit 100. Thus, fluid agitation can take place within the entire storing unit 100. Particularly, in a case where the first plate 420 constituting the one-side end of the blade 430 is supported by the base 810, and the second plate 440 is disposed adjacent to the neck part 120, the blade 430 can be formed over the entire length of the first storing space 102. In this case, the fluid agitation effect can be maximized.

Further, the outer edge 434 of the blade 430 may rotate in contact with the inner wall surface of the storing unit 100, so that the fluid can be prevented from being attached to the inner wall surface of the storing unit 100.

Additionally, the inner edge 432 of the blade 430 may include a portion spaced away from the insertion part 450, so that the flow generated by the blade 430 can be mixed in an up and down direction. Particularly, in a case where the outer edge 434 is in contact with the inner wall surface of the storing unit 100, the space between the inner edge 432 and the insertion part 450 may serve as an only path through which the fluid can be mixed in an up and down direction. At this time, the fluid flow formed spirally by the blade 430 and the fluid flow formed in an up and down direction in the space between the inner edge 432 and the insertion part 450 are mixed with each other, and thus more effective fluid agitation can take place.

The cosmetic container 1 according to an embodiment of the invention as described above can mix a fluid sufficiently with a less rotation number of the blade unit 400 since the blade unit 400 is formed continuously along the extension direction of the rotational axis.

Further, the blade unit 400 can prevent a fluid or other substance from being remained on the inner wall surface of the storing unit 100, the storing unit 100 can be always kept clean.

Further, as the tube 210 can be inserted into the insertion part 450, a pump including the tube 210 can be used as the discharging unit 200.

While until now the cosmetic container according to examples of the invention has been described as concrete embodiments, these are just exemplary embodiments, and the present invention should be construed in a broadest scope based on the fundamental technical ideas disclosed herein, rather than being limited to them. By combining or replacing a part or parts of embodiments disclosed herein, the ordinary skilled in the art may carry out a type of form which is not explicitly described herein, and however, it should be noted that it shall not depart from the scope of the present invention. Besides, the ordinary skilled in the art may easily change or modify embodiments disclosed herein based on the invention, and however, it is obvious that such change or modification also falls within the scope of the present invention.

REFERENCE SIGNS LIST

| | |
|---|---|
| 1: cosmetic container | 10: container main body |
| 100: storing unit | 200: discharging unit |
| 300: fluid supporting unit | 400: blade unit |
| 500: rotating unit | 600: check valve |
| 700: first valve | 800: driving force transferring unit |

What is claimed is:

1. A cosmetic container, comprising:

a storing unit providing a first storing space which can store fluid;

a discharging unit which discharges the fluid stored in the storing unit to the outside; and a fluid supporting unit which can support from a lower direction fluid which has been discharged to the outside;

a rotating unit which is provided rotatably relative to the storing unit; and a blade unit including one or more blades which rotate around a rotational axis in the first storing space by rotation of the rotating unit, wherein the blade unit includes:

a central part which receives a rotating force from the rotating unit to serve as a rotational center; and an insertion part which is formed in a shape extending from the central part and surrounding the discharging unit.

2. The cosmetic container of claim 1, wherein the fluid supporting unit includes a first surface which has a concave shape, so that the discharged fluid can stay therein.

3. The cosmetic container of claim 1, wherein the fluid supporting unit includes a second surface which presses the discharging unit; and a third surface which moves while being guided by the discharging unit.

4. The cosmetic container of claim 1, wherein a check valve is provided, which is coupled to one side of the fluid supporting unit so as to prevent the fluid discharged to the outside from flowing backward to the storing unit.

5. The cosmetic container of claim 1, wherein a first valve is provided, which is provided at a part of the discharging unit to selectively close the discharge of fluid from the first storing space.

6. The cosmetic container of claim 1, wherein the discharging unit includes:

a tube through which the fluid stored in the storing unit is intaken;

a pumping part which supports the fluid supporting unit and generates pressure for pumping the fluid stored in the storing unit; and a connecting part which connects the tube with the pumping part.

7. The cosmetic container of claim 6, wherein the pumping part includes:

a first part that provides a surface which is coupled to the fluid supporting unit to support the fluid supporting unit;

a second part that provides a surface on which the first part slides; and an elastic part that is provided between the first part and the second part to provide force by which the first part is relatively moved with respect to the second part.

8. The cosmetic container of claim 1, wherein on a lower side of the storing unit, a second storing space is formed, which has a concave shape, so that fluid can be collected below a tube for discharging the fluid to the outside.

9. The cosmetic container of claim 8, wherein the second storing space is provided so as to overlap the rotational axis.

10. The cosmetic container of claim 9, wherein the second storing space is provided on the central part.

11. The cosmetic container of claim 10, wherein on a circumference of the insertion part, a cutaway portion is formed, so that fluid can flow into the second storing spaced from the first storing space.

12. The cosmetic container of claim 11, wherein the cutaway portion includes a first cutaway portion formed at an upper side of the insertion part and a second cutaway portion formed at a lower side of the insertion part, and wherein the fluid stored in the first storing space is introduced into the second storing space through at least one of the first cutaway portion and the second cutaway portion by rotation of the blade.

13. The cosmetic container of claim 10, wherein the blade unit includes:

a first plate which is disposed on a lower end of the insertion part; and a second plate which is disposed on an upper end of the insertion part, and wherein the blade and the first plate rotate relative to each other, so that the fluid on the first plate can flow into the second storing space.

14. The cosmetic container of claim 9, wherein a driving force transferring unit is provided, which is provided at one side of the storing unit, and which transfers rotation of the rotating unit to the blade unit.

15. The cosmetic container of claim 1, wherein the storing unit is formed of a transparent material.

16. The cosmetic container of claim 1, wherein the storing unit has a cylindrical shape, and a diameter of the storing unit is greater than an up and down direction length of the storing unit.

* * * * *